US009434560B2

(12) United States Patent
Okada et al.

(10) Patent No.: US 9,434,560 B2
(45) Date of Patent: Sep. 6, 2016

(54) SHEET FEEDER AND IMAGE FORMING APPARATUS

(71) Applicant: KYOCERA Document Solutions Inc., Osaka-shi, Osaka (JP)

(72) Inventors: Seiji Okada, Osaka (JP); Keiji Okumura, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/923,706

(22) Filed: Oct. 27, 2015

(65) Prior Publication Data

US 2016/0122142 A1 May 5, 2016

(30) Foreign Application Priority Data

Oct. 29, 2014 (JP) ..... 2014-220688

(51) Int. Cl.

| | |
|---|---|
| ***B65H 1/04*** | (2006.01) |
| ***B65H 1/00*** | (2006.01) |
| ***B65H 3/06*** | (2006.01) |
| ***B65H 1/26*** | (2006.01) |
| ***B65H 7/02*** | (2006.01) |

(52) U.S. Cl.

CPC *B65H 1/04* (2013.01); *B65H 1/00* (2013.01); *B65H 1/266* (2013.01); *B65H 3/06* (2013.01); *B65H 7/02* (2013.01); *B65H 2403/411* (2013.01); *B65H 2511/11* (2013.01); *B65H 2511/12* (2013.01)

(58) Field of Classification Search

CPC ..... B65H 1/04; B65H 1/00; B65H 2511/12; B65H 2511/10; B65H 2403/411

See application file for complete search history.

(56) References Cited

U.S. PATENT DOCUMENTS

| | | | | |
|---|---|---|---|---|
| 6,070,048 | A * | 5/2000 | Nonaka | B65H 1/00 399/376 |
| 8,210,525 | B2 * | 7/2012 | Ushiyama | B65H 1/266 271/171 |
| 2007/0200288 | A1 | 8/2007 | Yoshiuchi | |
| 2011/0127714 | A1 * | 6/2011 | Kuo | B65H 1/00 271/171 |

FOREIGN PATENT DOCUMENTS

| | | |
|---|---|---|
| JP | 2007-230703 | 9/2007 |

* cited by examiner

*Primary Examiner* — Luis A Gonzalez

(74) *Attorney, Agent, or Firm* — Gerald E. Hespos; Michael J. Porco; Matthew T. Hespos

(57) ABSTRACT

A holding member of a sheet feeder includes a locking member engageable with a part of a pinion gear and holds the pinion gear and a sensor member. The holding member is detachably attachable to the sheet storage portion. The pinion gear and a pair of rack members are meshed with the holding member attached to a sheet storage portion. The holding member holds the pinion gear movably in an axial direction of the rotary shaft so that the pinion gear is displaceable between a first position where the rotation of the pinion gear is regulated and a second position where the pinion gear is rotatable. The pinion gear is located at the first position with the holding member detached from the sheet storage portion and located at the second position with the holding member attached to the sheet storage portion.

7 Claims, 11 Drawing Sheets

SHEET FEEDER AND IMAGE FORMING APPARATUS

INCORPORATION BY REFERENCE

This application is based on Japanese Patent Application No. 2014-220688 filed with the Japan Patent Office on Oct. 29, 2014, the contents of which are hereby incorporated by reference.

BACKGROUND

The present disclosure relates to a sheet feeder for feeding a sheet in a predetermined sheet feeding direction and an image forming apparatus to which the sheet feeder is applied.

An image forming apparatus such as a copier or a printer includes a sheet cassette (sheet feeder) for storing sheets to which an image is to be transferred. This sheet cassette is provided with a pair of side guides which are slid according to the size of stored sheets and guide lateral sides of the sheets. One and the other of the side guides are moved in conjunction with each other by an interlocking mechanism including rack members and a pinion gear.

There is known a detection technology for automatically detecting the size of sheets stored in a sheet cassette by assembling a sensor member with a pinion gear. A variable resistor with a movable electrode is generally used as the sensor member and a rotary shaft of the pinion gear is coupled to the movable electrode. The movable electrode is rotated by the rotation of the pinion gear associated with sliding movements of side guides, whereby a resistance value of the variable resistor changes. By monitoring this change of the resistance value, the size of the stored sheets is discriminated.

SUMMARY

A sheet feeder according to one aspect of the present disclosure includes a sheet storage portion, a pair of side guides, a pair of rack members, a pinion gear, a sensor member and a holding member.

The sheet storage portion stores a sheet to be fed. The pair of side guides are provided in the sheet storage portion, slidable in directions perpendicular to a sheet feeding direction and guide a pair of lateral sides of the sheet extending along the sheet feeding direction. The pair of rack members are integrally mounted on the respective side guides. The pinion gear includes a rotary shaft and rotates about an axis of the rotary shaft in a state meshed with the pair of rack members. The sensor member includes a rotating portion coupled to the rotary shaft and has an electrical characteristic changing according to a degree of rotation of the rotating portion rotating in conjunction with the rotary shaft. The holding member includes a locking member engageable with a part of the pinion gear and holds the pinion gear and the sensor member.

The holding member is detachably attachable to the sheet storage portion and configured such that the pinion gear and the rack members are meshed with the holding member attached to the sheet storage portion, and holds the pinion gear movably in an axial direction of the rotary shaft so that the pinion gear is displaceable between a first position where a part of the pinion gear is engaged with the locking member to regulate the rotation of the pinion gear and a second position where the engagement is released to make the pinion gear rotatable. The pinion gear is located at the first position with the holding member detached from the sheet storage portion and located at the second position with the holding member attached to the sheet storage portion.

An image forming apparatus according to another aspect of the present disclosure includes the above sheet feeder and an image forming unit configured to form an image on a sheet fed from the sheet feeder.

DETAILED DESCRIPTION

Figure 1:
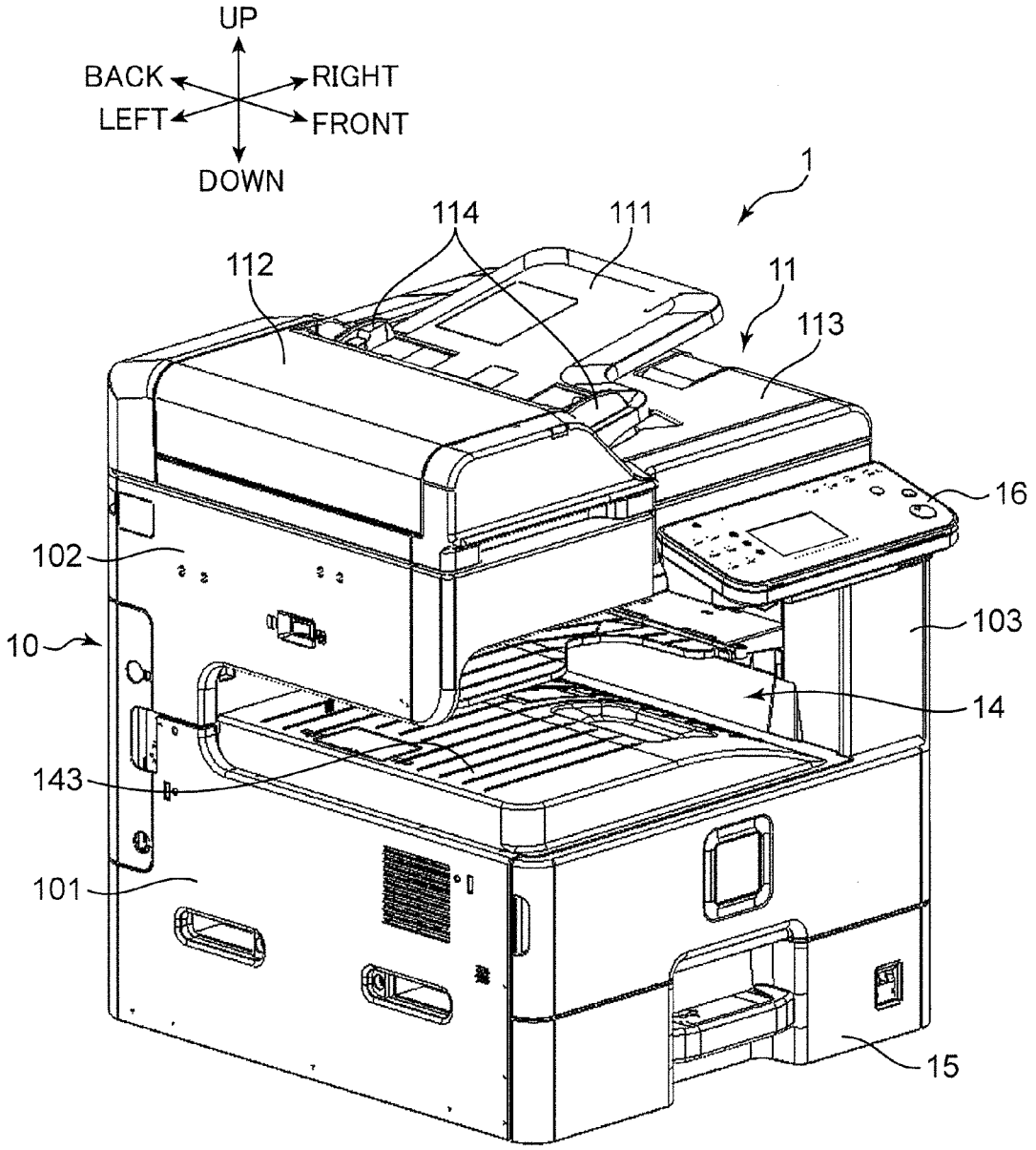
FIG. 1 is a perspective view of an image forming apparatus according to one embodiment of the present disclosure.
Figure 2:
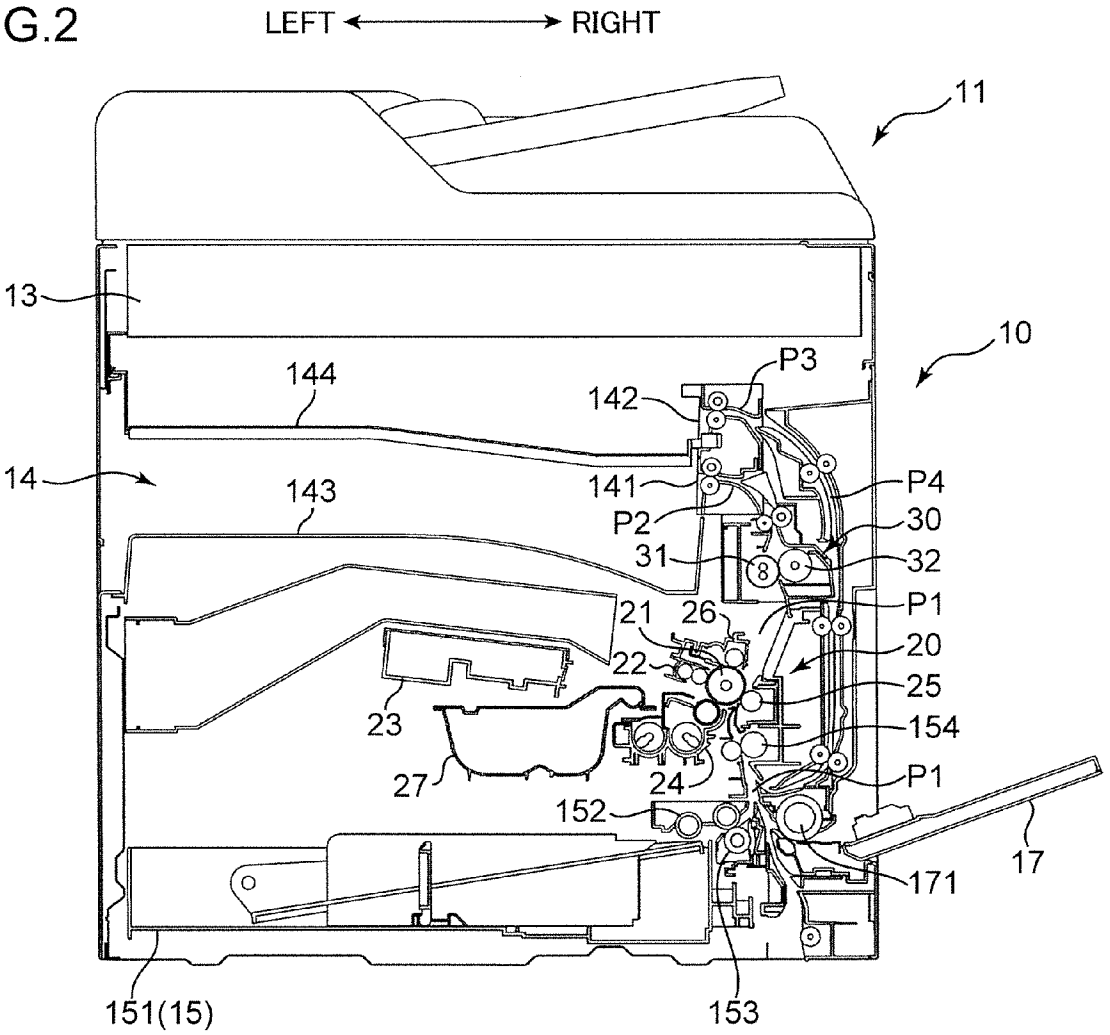
FIG. 2 is a sectional view showing the internal structure of the image forming apparatus.

Hereinafter, an embodiment of the present disclosure is described in detail with reference to the drawings. FIG. 1 is a perspective view of an image forming apparatus 1 according to one embodiment of the present disclosure, and FIG. 2 is a sectional view showing the internal structure of the image forming apparatus 1. Although a monochrome copier is illustrated as the image forming apparatus 1 here, the image forming apparatus may be a monochrome printer, a color printer, a facsimile machine or a complex machine provided with these functions.

The image forming apparatus 1 includes a substantially rectangular parallelepipedic main body housing 10 and an automatic document feeder 11 arranged on the upper surface of the main body housing 10. The main body housing 10 includes a lower housing 101, an upper housing 102 arranged above the lower housing 101 and a coupling housing 103 coupling the lower and upper housings 101, 102. Various devices for transferring a toner image to a sheet are housed in the lower housing 101. A scanner device 13 for optically reading an image of a document sheet is housed in the upper housing 102.

An internal space surrounded by the lower housing 101, the upper housing 102 and the coupling housing 103 serves as an internal discharging unit 14 capable of storing sheets after image formation. The coupling housing 102 is provided with a first discharge port 141 and a second discharge port 142 open toward the internal space. A bottom part of the internal space is defined by the upper surface of the lower housing 101 and this upper surface serves as an internal sheet discharge tray 143. Sheets discharged from the first discharge port 141 are stacked on the internal sheet discharge tray 143. An auxiliary sheet discharge tray 144 is mounted above the internal sheet discharge tray 143. Sheets discharged from the second discharge port 142 are stacked on the auxiliary sheet discharge tray 144 or a sheet to be printed on both sides is temporarily discharged to the auxiliary sheet discharge tray 144 for switchback conveyance.

A sheet cassette 15 (sheet feeder) for storing sheets to which an image forming process is to be applied is detachably mounted in the lower housing 101. Further, an operation unit 16 is provided to project on the front surface of the upper housing 102. The operation unit 16 includes an LCD touch panel, a numeric keypad, a start key and the like and receives the input of various operation instructions from a user.

The automatic document feeder 11 automatically feeds a document sheet to be copied by way of an image reading position set on the upper surface of the main body housing 10. The automatic document feeder 11 includes a document tray 111 on which the document sheets are to be placed, a document conveying unit 112 for automatically conveying the document sheets one by one by way of the image reading position and a document discharge tray 113 to which the document sheets after reading are to be discharged. The document tray 111 is provided with a pair of side guides 114 for guiding lateral sides of the document sheet extending along a conveying direction. The side guides 114 can be slid in directions perpendicular to the conveying direction according to the size of the document sheet.

With reference to FIG. 2, an image forming unit 20, a fixing unit 30 and a sheet conveying path are housed in the main body housing 10 in addition to the aforementioned scanner device 13 and sheet cassette 15. The image forming unit 20 is for performing a process of forming an image on a sheet fed from the sheet cassette 15 or the like and includes a photoconductive drum 21 and a charger 22, an exposure unit 23, a developing device 24, a transfer roller 25 and a cleaning device 26 arranged around this photoconductive drum 21.

The photoconductive drum 21 has a circumferential surface which rotates about an axis of the photoconductive drum 21 and on which an electrostatic latent image and a toner image are to be formed. The charger 22 uniformly charges the circumferential surface of the photoconductive drum 21. The exposure unit 23 irradiates the circumferential surface of the photoconductive drum 21 with laser light to form an electrostatic latent image. The developing device 24 supplies toner to the circumferential surface of the photoconductive drum 21 to develop an electrostatic latent image formed on the photoconductive drum 21. The transfer roller 25 forms a transfer nip portion together with the photoconductive drum 21 and transfers a toner image on the photoconductive drum 21 to a sheet. The cleaning device 26 cleans the circumferential surface of the photoconductive drum 21 after the transfer of the toner image. A toner container 27 for supplying the toner to the developing device 24 is arranged adjacent to the developing device 24.

The fixing unit 30 is arranged in the coupling housing 103 and includes a fixing roller 31 with a built-in heat source and a pressure roller 32 forming a fixing nip portion together with the fixing roller 31. The fixing unit 30 applies a fixing process by heating and pressing a sheet having a toner image transferred thereto in the transfer nip portion in the fixing nip portion. The sheet having the fixing process applied thereto is discharged toward the internal sheet discharging unit 14 from the first or second discharge port 141 or 142.

The sheet conveyance path includes a main conveyance path P1 vertically extending from the vicinity of a lower part to the vicinity of an upper part of the main body housing 10 by way of the image forming unit 20 and the fixing unit 30. A first discharging conveyance path P2 for introducing a sheet to the first discharge port 141 is branched near a downstream end of the main conveyance path P1. Further, a second discharging conveyance path P3 for introducing a sheet to the second discharge port 142 is connected to a most downstream end (upper end) of the main conveyance path P1. Further, a reversing conveyance path P4 for reversing and conveying a sheet at the time of double-sided printing extends from the most downstream end to the vicinity of an upstream end of the main conveyance path P1.

The sheet cassette 15 includes a sheet storage portion 151 for storing a stack of sheets to be fed. The sheet storage portion 151 is a box-shaped container with an opening in the upper surface, the sheet storage portion 151 including a bottom plate and side plates defining a storage space for the sheet stack. A pickup roller 152 for picking up the uppermost sheet of the sheet stack one by one and a pair of feed rollers 153 for feeding the sheet to the upstream end of the main conveyance path P1 are provided near a right-upper corner of the sheet storage portion 151. Further, a manual feed tray 17 for manual sheet feeding is provided on the right side surface of the main body housing 10. A sheet placed on the manual feed tray 17 is fed to the upstream end of the main conveyance path P1 by a manual feed roller 171. A pair of registration rollers 154 for feeding the sheet to the transfer nip portion at a predetermined timing are arranged upstream of the image forming unit 20 in the main conveyance path P1.

In the case of applying a one-sided printing (image forming) process to a sheet, the sheet is fed to the main conveyance path P1 from the sheet storage portion 15 or the manual feed tray 17, a processing of transferring a toner image to the sheet is performed in the image forming unit 20 and a process of fixing the transferred toner to the sheet is performed in the fixing unit 30. Thereafter, the sheet is discharged onto the internal sheet discharge tray 143 from the first discharge port 141 by way of the first discharging conveyance path P2. On the other hand, in the case of applying a double-sided printing process to a sheet, after the transferring process and the fixing process are applied to one side of the sheet, the sheet is partly discharged onto the auxiliary sheet discharge tray 144 from the second discharge port 142 by way of the second discharging conveyance path P3. Thereafter, the sheet is switchback-conveyed and returned to the vicinity of the upstream end of the main conveyance path P1 by way of the reversing conveyance path P4. Thereafter, the transferring process and the fixing process are applied to the other side of the sheet and the sheet is discharged onto the internal sheet discharge tray 143 from the first discharge port 141 by way of the first discharging conveyance path P2.

In the image forming apparatus 1 configured as described above, the side guide unit for guiding lateral sides of the stored sheet stack facing in a width direction perpendicular to the sheet feeding direction is assembled with the sheet cassette 15 (sheet feeder). Sheets of different sizes such as A4 size and B5 size are stored in the sheet storage portion 151 of the sheet cassette 15. Even sheets of the same sheet size have different sizes in the width direction depending on which of long-edge feeding or short-edge feeding is adopted. The side guide unit supports the lateral sides of the sheet stack according to various sizes in the width direction. The side guide unit is described in detail below.

Figure 3:
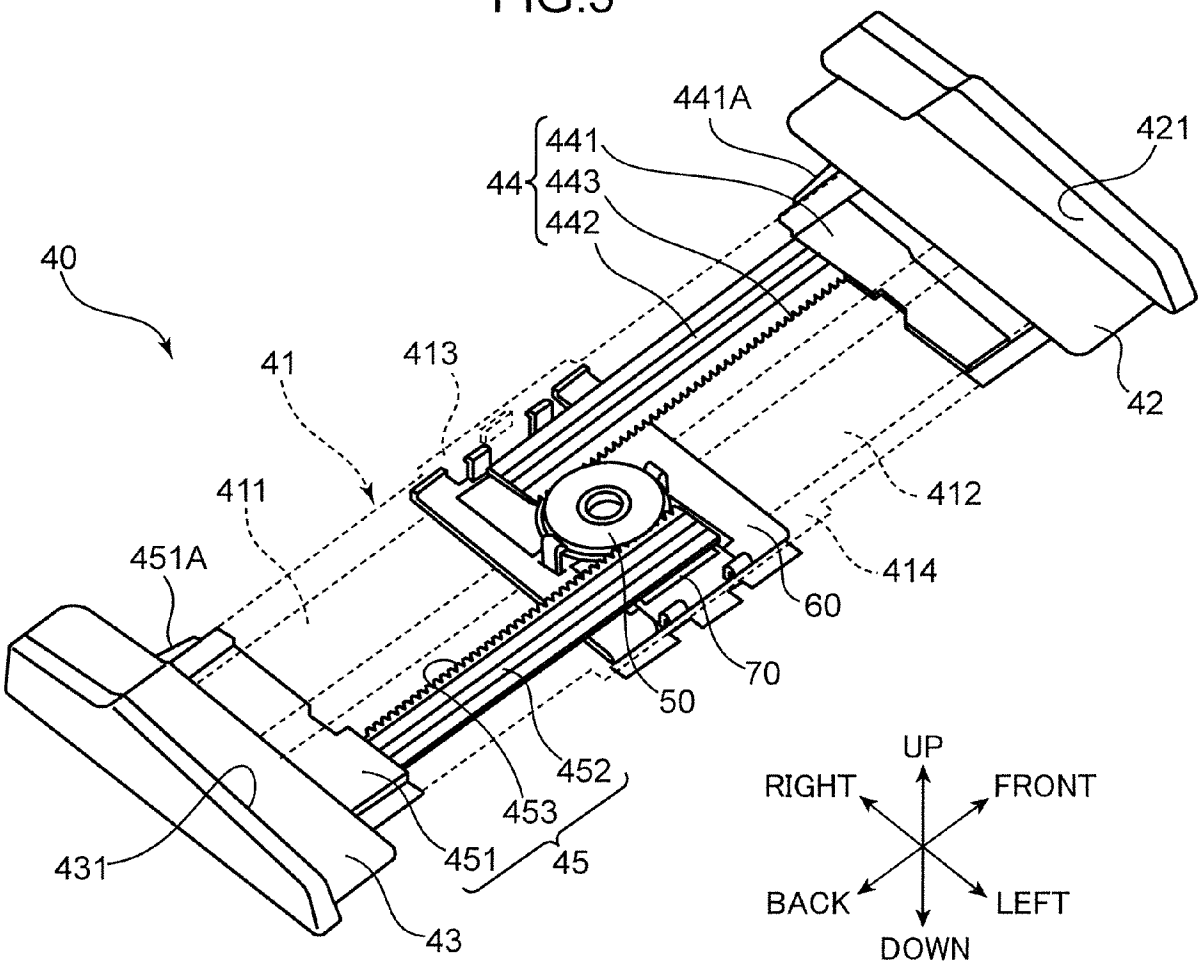
FIG. 3 is a perspective view showing a sheet feeder (side guide unit) according to one embodiment of the present disclosure.

FIG. 3 is a perspective view showing a side guide unit 40 according to one embodiment of the present disclosure. The side guide unit 40 includes a base member 41, a first side guide 42 and a second side guide 43 (a pair of side guides), a first rack member 44 and a second rack member 45 (a pair of rack members), a pinion gear 50, a holding member 60 and a sensor member 70.

The base member 41 is a plate-like member long in the front-back direction, i.e. the width direction of the sheets and a member configured to hold the holding member 60 for the pinion gear 50 and serving as a movement base for the first and second side guides 42, 43 and the first and second rack members 44, 45. The base member 41 may be formed by a part of the bottom plate of the sheet storage portion 151 or may be assembled as a separate member with the bottom plate. The base member 41 is provided with a first guide groove 411 and a second guide groove 412 formed of shallow recesses extending in the front-back direction and arranged in parallel. Further, a first engaging piece 413 and a second engaging piece 414 are respectively provided on the right side and the left side near a center of the base member 41 in the front-back direction. Note that an upper plate (not shown) for covering over the first and second rack members 44, 45 and the pinion gear 50 is mounted on an upper surface side of the base member 41. The sheet stack stored in the sheet storage portion 151 is placed on this upper plate.

The first and second side guides 42, 43 guide a pair of lateral sides of the sheets (sheet stack) stored in the sheet storage portion 151 extending along the sheet feeding direction. The first and second side guides 42, 43 are arranged on the upper surface of the base member 41 and slide in directions perpendicular to the sheet feeding direction along the base member 41. In this embodiment, the first side guide 42 is assembled on a front end side of the base member 41 and the second side guide 43 is assembled on a rear end side of the base member 41. Each side guide 42, 43 includes a guide side wall 421, 431 which comes into contact with the lateral sides of the sheets.

The first and second rack members 44, 45 are members arranged on the upper surface side of the base member 41 and respectively integrally mounted on the first and second side guides 42, 43. The first rack member 44 includes a slider portion 441, a rack base 442 and rack gear teeth 443. The slider portion 441 is a member coupling the first side guide 42 and the rack base 442, has a width slight longer than a lateral width of the base member 41 and has a bent shape in conformity with an uneven shape of the first and second guide grooves 411, 412.

The slider portion 441 includes a pair of connecting portions 441A respectively standing on left and right end edges. Each connecting portion 441A has a height longer than a vertical thickness of the base member 41 and is fixed to the underside of the first side guide 42 through the left or right side of the base member 41. Specifically, the base member 41 is embraced by an assembly of the slider portion 441 and the first side guide 42. This enables the first side guide 42 and the first rack member 44 to slide in the front-back direction along the base member 41.

The rack base 442 is a rectangular plate-like member long in the front-back direction and having one end coupled to the slider portion 441. The rack gear teeth 443 are formed on a left side (straight part) of the rack base 442. When the first side guide 42 and the first rack member 44 slide, the rack base 442 moves along the first guide groove 411.

Similarly, the second rack member 45 includes a slider portion 451, a rack base 452 and rack gear teeth 453. The slider portion 451 includes a pair of left and right connecting portions 451A and is integrally connected to the second rack member 45 and the second side guide 43 via the connecting portions 451A. The rack gear teeth 453 are formed on a right side (straight part) of the rack base 452. When the second side guide 43 and the second rack member 45 slide, the rack base 452 moves along the second guide groove 412. The first and second rack members 44, 45 are arranged such that the rack bases 442, 452 are parallel with a constant interval (interval corresponding to a diameter of the pinion gear 50) defined between the rack gear teeth 443, 453.

Figure 4:
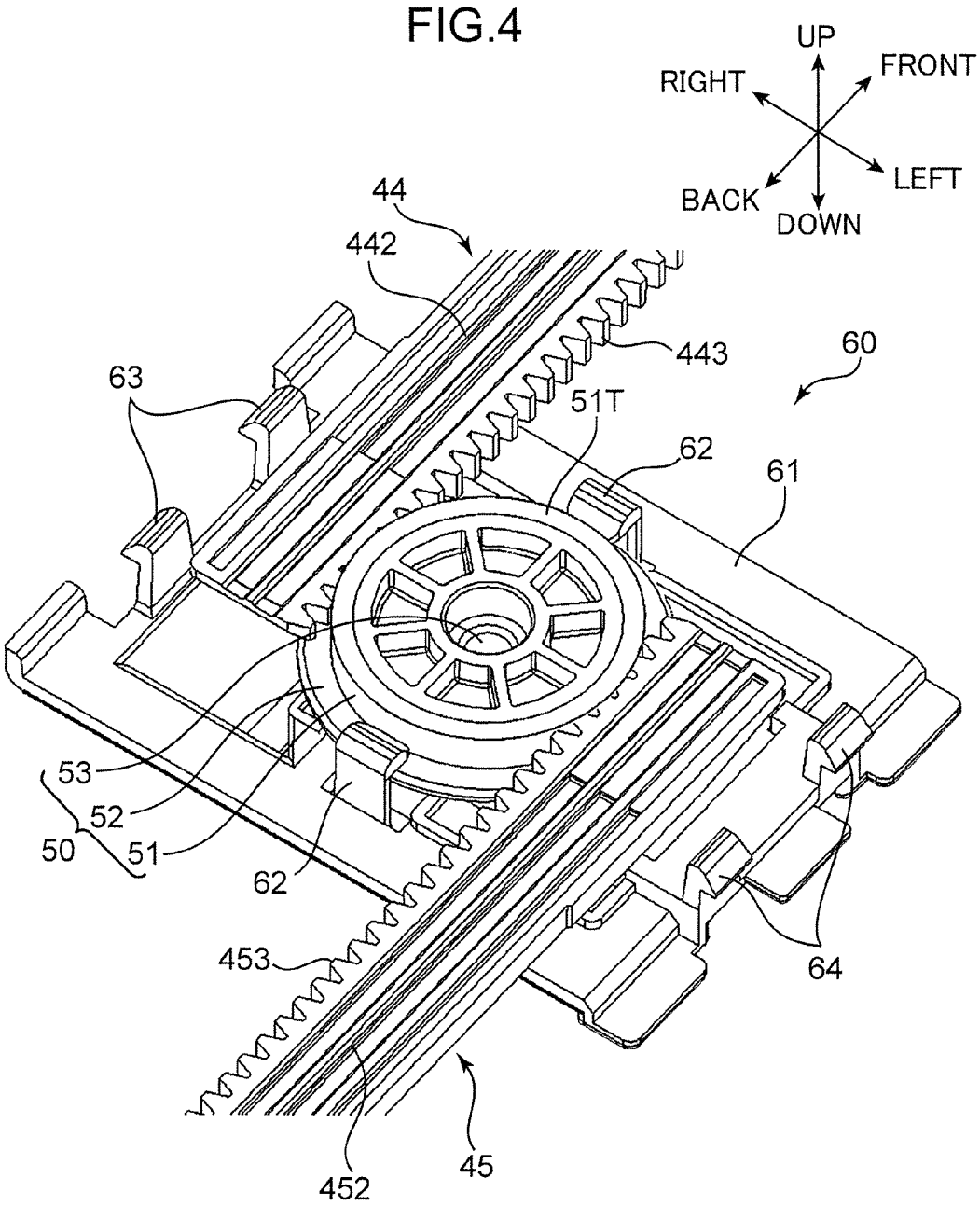
FIG. 4 is a perspective view of a part of the sheet feeder around a pinion gear.

The pinion gear 50 is a circular gear member meshed with both rack gear teeth 443, 453 of the first and second rack members 44, 45. FIG. 4 is a perspective view of a part around the pinion gear 50. The pinion gear 50 includes a hollow cylindrical portion 51T formed with pinion gear teeth 51 on an outer periphery of the cylindrical portion 51T, a flange portion 52 connected to the lower end of this hollow cylindrical portion 51T and having a larger diameter than the hollow cylindrical portion 51T and a rotary shaft 53 arranged at an axial center of the hollow cylindrical portion 51T.

The pinion gear 50 rotates about an axis of the rotary shaft 53 with the pinion gear teeth 51 thereof meshed with both rack gear teeth 443, 453. For example, if a user moves the first rack member 44 (first side guide 42) backward from a front side in FIG. 3, the pinion gear 50 rotates in a counterclockwise direction about the axis of the rotary shaft 53 by the engagement of the linearly arranged rack gear teeth 443 and the circularly arranged pinion gear teeth 51. When the pinion gear 50 rotates, the second rack member 45 (second side guide 43) moves forward from a rear side by the engagement of the pinion gear teeth 51 and the rack gear teeth 453. Specifically, the first and second side guides 42, 43 can move in conjunction with each other in directions toward or away from each other by the engagement of the first and second rack members 44, 45 and the pinion gear 50.

Figure 5:
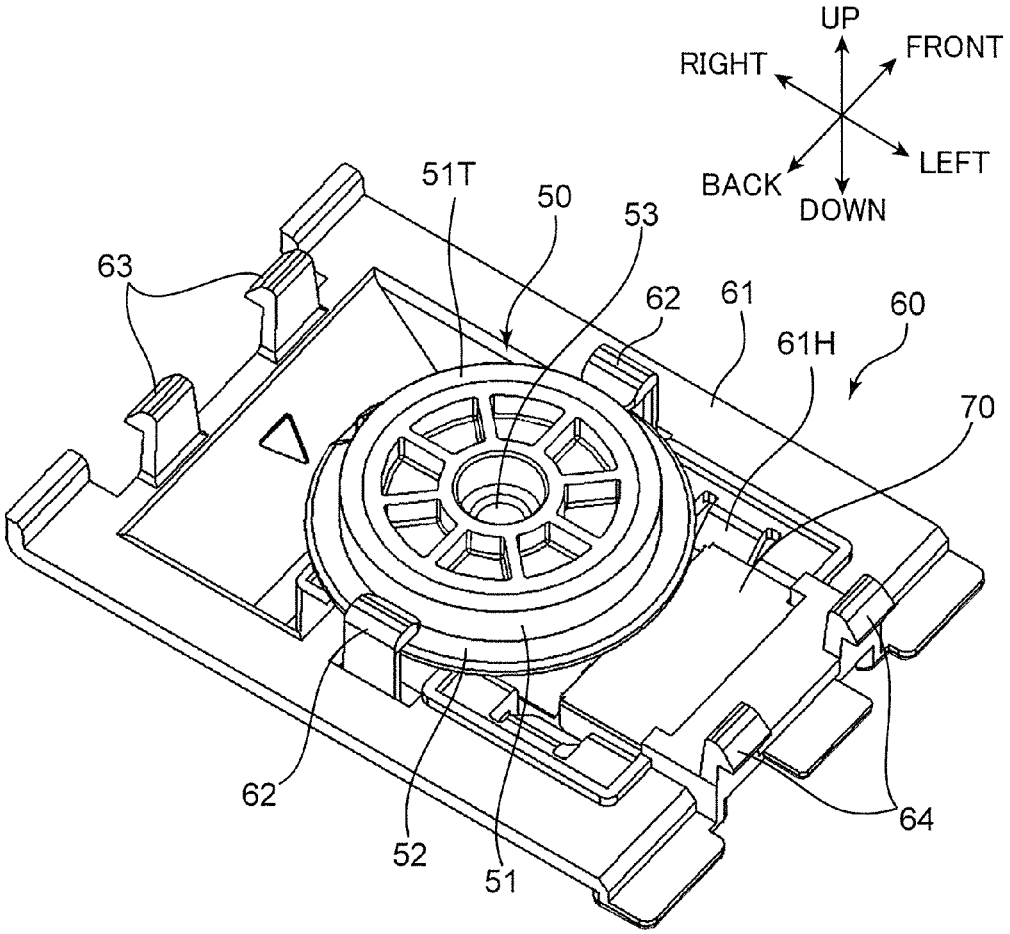
FIG. 5 is a perspective view with rack members removed from FIG. 4.
Figure 6:
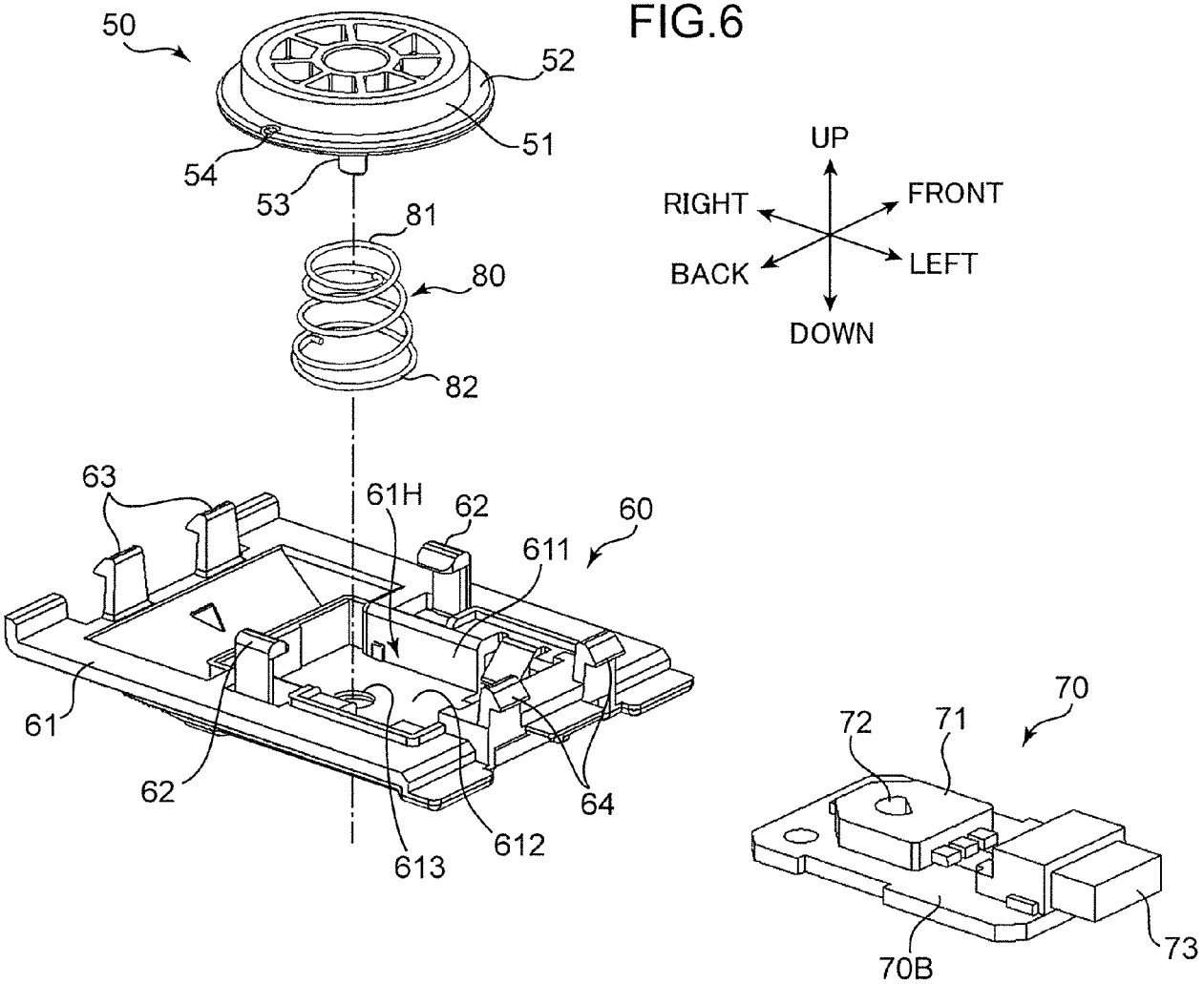
FIG. 6 is an exploded perspective view of an essential part of the sheet feeder.

The holding member 60 is a housing for holding the pinion gear 50 and the sensor member 70 and a member detachably attached to the base member 41 (sheet storage portion 151). FIG. 5 is a perspective view with the rack members 44, 45 removed from FIG. 4 showing an assembly of the pinion gear 50, the holding member 60 and the sensor member 70. FIG. 6 is an exploded perspective view of the assembly. The holding member 60 includes a holding base 61, a pair of locking members 62, a pair of first locking hooks 63 and a pair of second locking hooks 64.

The holding base 61 is a member rectangular in a plan view and has a lateral width wider than the sum of lateral widths of the pinion gear 50 and the rack bases 442, 452 of the first and second rack members 44, 45 meshed with the pinion gear 50 as shown in FIG. 4. The holding base 61 is provided with a recess 61H serving as a housing space for the sensor member 70. The recess 61H is formed by a side plate 611 and a bottom plate 612 defining the housing space matching the size of the sensor member 70. A through hole 613 serving as a bearing for the rotary shaft 53 of the pinion gear 50 is perforated on the bottom plate 612.

The pair of locking members 62 respectively stand upward from the vicinities of front and rear sides near a center of the holding base 61 in the lateral direction. An interval between base end parts (support column portions 621; see FIG. 10) where the pair of locking members 62 stand up is substantially equal to a diameter of the flange portion 52 of the pinion gear 50. The pair of locking members 62 are members engaged with the flange portion 52 of the pinion gear 50 (part of the pinion gear) and function to regulate the rotation of the pinion gear 50 about the rotary shaft 53. Due to this rotation regulation, each locking member 62 includes a boss 623 (FIG. 10A) fittable into a receiving portion 54 (engaging portion) of the flange portion 52. This point is described in detail later.

The first locking hook 63 is a cantilever-type snap-fit member standing from the vicinity of the right side of the holding member 61. The first locking hook 63 can be engaged with and disengaged from the first engaging piece 413 of the base member 41 by being elastically deformed. Similarly, the second locking hook 64 is a cantilever-type snap-fit member standing from the vicinity of the left side of the holding member 61. The second locking hook 64 can be engaged with and disengaged from the second engaging piece 414 of the base member 41 by being elastically deformed. Note that the aforementioned pair of locking members 62 are also cantilever-type snap-fit members similar to these locking hooks 63, 64.

Specifically, the holding member 60 can be attached to the base member 41 by snap-fitting the first and second locking hooks 63, 64 and the first and second engaging pieces 413, 414, and detached from the base member 41 by releasing the snap-fit state. By attaching the holding member 60 holding the pinion gear 50 to the base member 41, the pinion gear teeth 51 of the pinion gear 50 and the rack gear teeth 443, 453 of the first and second rack members 44, 45 are meshed.

The sensor member 70 is a sensor unit for automatically detecting the size of the sheets stored in the sheet storage portion 151. The sensor member 70 includes a board 70B, a variable resistor 71 (rotating portion) mounted on the board 70B and a connection terminal 73. The variable resistor 71 is a rotary potentiometer and includes a bearing hole 72 in a central part. By the rotation of a component (movable electrode; not shown) including this bearing hole 72, a resistance value of the variable resistor 71 changes. Specifically, a terminal voltage of the connection terminal 73 changes according to the above rotation.

Figure 7:
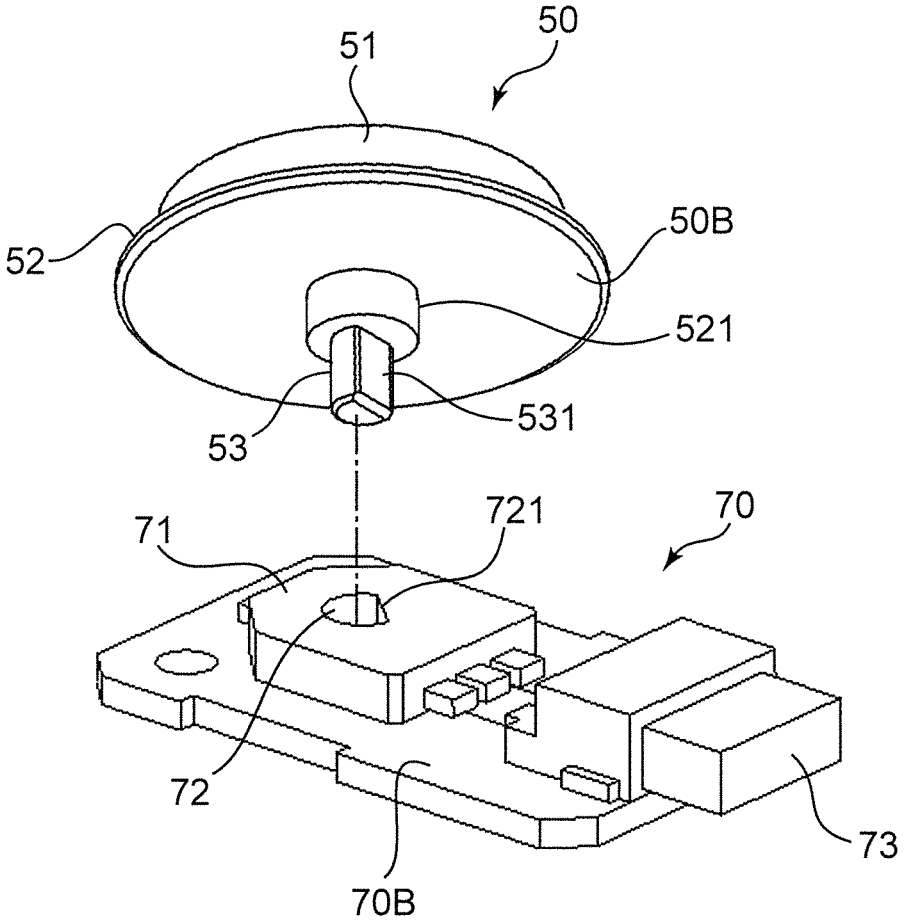
FIG. 7 is a perspective view showing a relationship of the pinion gear and a sensor member.

FIG. 7 is a perspective view showing a relationship of the pinion gear 50 and the sensor member 70. A cylindrical boss 521 is provided to project on a bottom surface 50B of the pinion gear 50 and the rotary shaft 53 projects from the lower surface of the boss 521. This rotary shaft 53 is inserted into (coupled to) the bearing hole 72 of the variable resistor 71. The rotary shaft 53 has a D-cut surface 531. A D-cut surface 721 of a size corresponding to the D-cut surface 531 is provided on the rotary shaft 53. At the time of this insertion, the resistance value of the variable resistor 71 is set to an initial value. Specifically, a mark indicating an initial position (position where the resistance value is the initial value) of the variable resistor 71 is attached to the side of the sensor member 70 and, after the insertion, the pinion gear 50 is rotated to align the rotational position of the movable electrode with the mark. Note that an outer diameter of the pinion gear 50 is selected to be such a diameter capable of covering a movable range of the first and second rack members 44, 45 within one rotation of the pinion gear 50.

When the pinion gear 50 rotates with the rotary shaft 53 inserted in the bearing hole 72, the movable electrode of the variable resistor 71 also rotates in conjunction with the pinion gear 50. The first and second side guides 42, 43 are slid to guide the sheets to a specific size. When the pinion gear 50 rotates in association with this, the resistance value of the variable resistor 71 reaches a specific value and the terminal voltage of the connection terminal 72 indicates a unique voltage value (electrical characteristic corresponding to a degree of rotation of the rotating portion). Thus, the sheet size can be detected by monitoring the terminal voltage.

Figure 8:
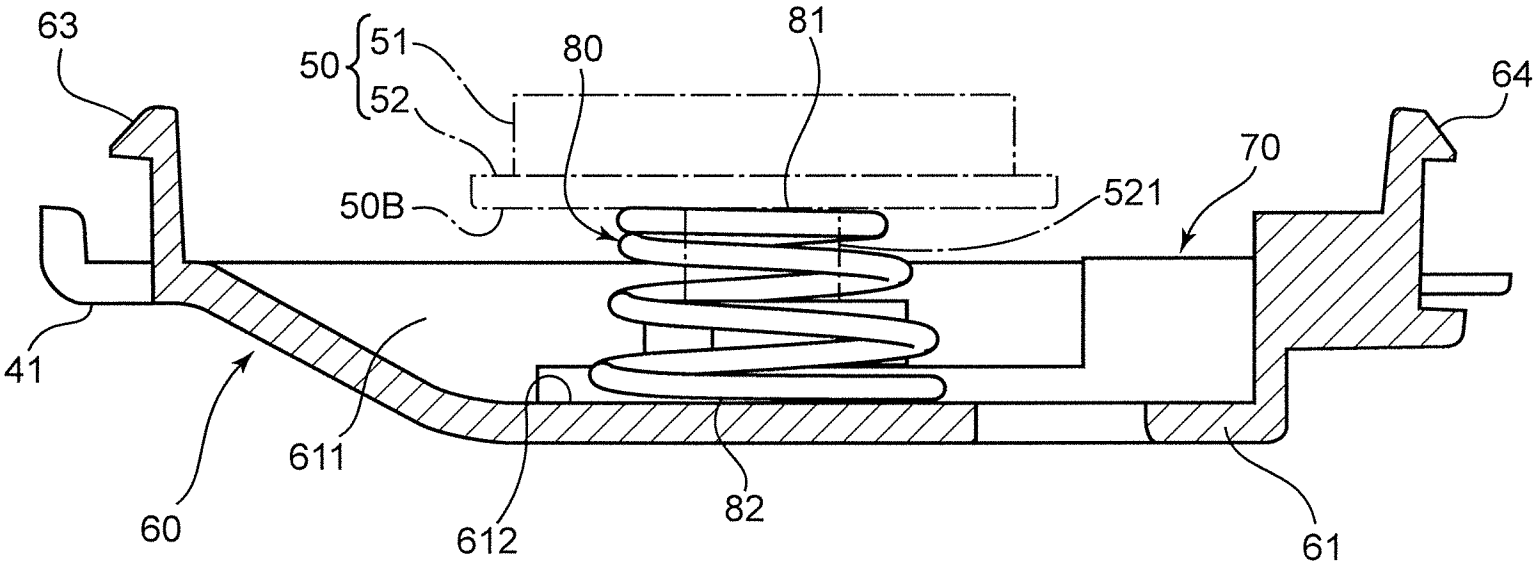
FIG. 8 is a sectional view of an essential part of the sheet feeder.

A coil spring 80 (biasing member) is interposed between the holding member 60 and the pinion gear 50. FIG. 8 is a lateral sectional view of the side guide unit 40 at an arrangement position of the pinion gear 50. An upper end coil portion 81 of the coil spring 80 is externally fitted on the boss 521 on the bottom surface 50B of the pinion gear 50 and held in contact with the bottom surface 50B. A lower end coil portion 82 of the coil spring 80 is held in contact with the holding base 61. The coil spring 80 biases the pinion gear 50 upwardly in an axial direction of the rotary shaft 53.

The pinion gear 50 is held movably in the axial direction of the rotary shaft 53 in the holding member 60. Specifically, the pinion gear 50 is positioned at a position where the flange portion 52 butts against the pair of locking members 62 (hereinafter, referred to as a "first position") by a biasing force of the coil spring 80 in a state where no downward pressing force is applied to the pinion gear 50. On the other hand, in a state where a downward pressing force is applied to the pinion gear 50 against the biasing force of the coil spring 80, the pinion gear 50 moves downward to approach the holding base 61 and is positioned at a position where the flange portion 52 is separated from the pair of locking members 62 (hereinafter, referred to as a "second position").

Figure 9:
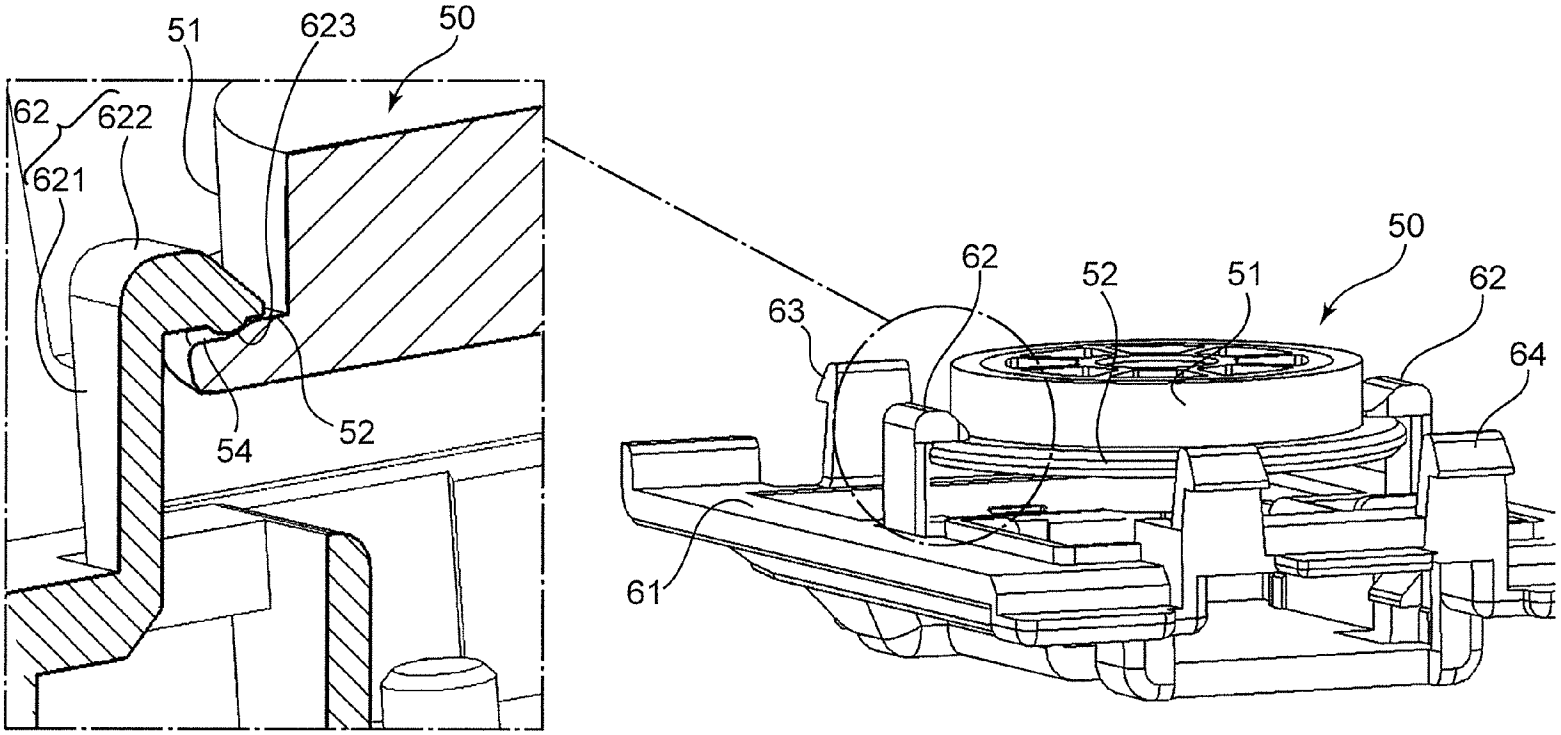
FIG. 9 is a perspective view including a partial enlarged view showing a relationship of the pinion gear and a holding member.

FIG. 9 is a perspective view including a partial enlarged view showing a relationship of the pinion gear 50 and the holding member 60. FIG. 9 shows a state (detached state) before the holding member 60 is attached to the base member 41 (sheet storage portion 151). Since the pressing force is not applied to the pinion gear 50 in this state, the pinion gear 50 is located at the first position. Thus, the flange portion 52 is pressed against the pair of locking members 62.

Figure 10A:
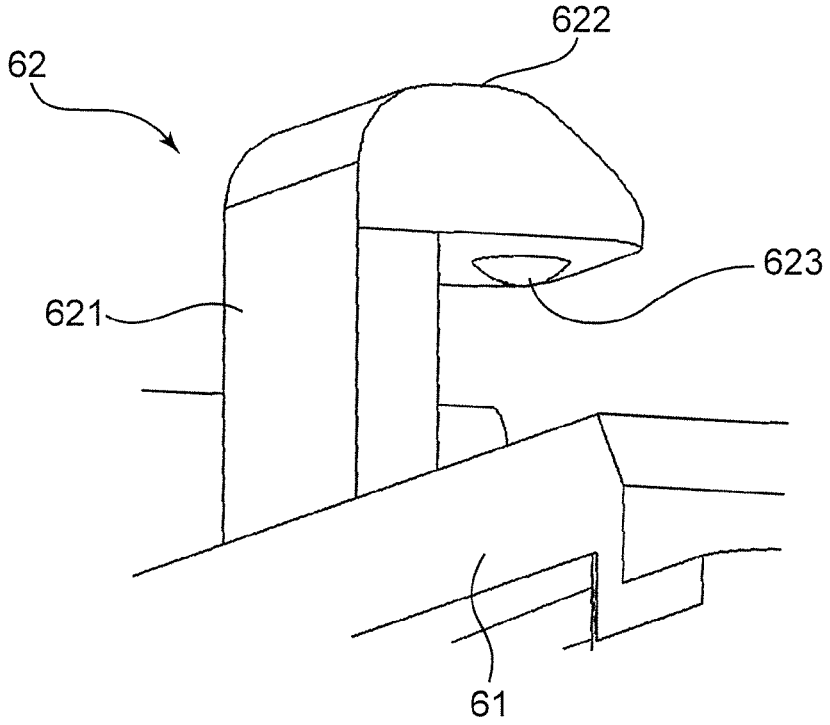
FIG. 10A is an enlarged perspective view of a locking member provided in the holding member.
Figure 10B:
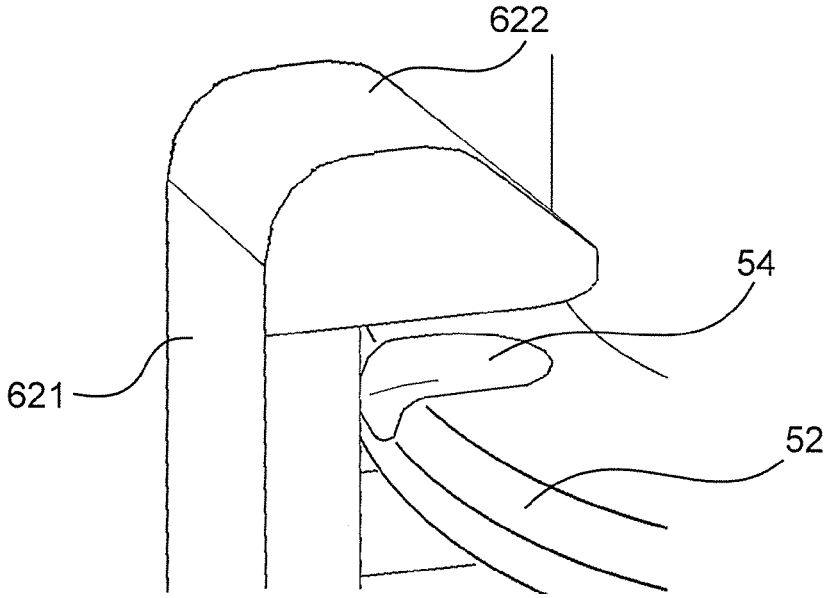
FIG. 10B is an enlarged perspective view showing an engaging portion provided on the pinion gear.

FIG. 10A is an enlarged perspective view of the locking member 62 and FIG. 10B is an enlarged perspective view of an essential part of the flange portion 52. The locking member 62 includes the support column portion 621, a hook portion 622 and the boss 623. The support column portion 621 is a member standing vertically upward from the holding base 61. The hook portion 622 extends from the top of the support column portion 621 in a direction toward the arrangement position of the pinion gear 50. The boss 623 is a semispherical projection projecting downward from the lower surface of the hook portion 622. The pair of locking members 62 are symmetrically positioned across the rotary shaft 53 of the pinion gear 50.

A pair of receiving portions 54 are provided on the upper surface of the flange portion 52 of the pinion gear 50. The receiving portions 54 are grooves extending from the outer peripheral edge of the flange portion 52 toward the axial center of the pinion gear 50. A cross-sectional shape of the receiving portion 54 in a direction perpendicular to an extending direction thereof is semicircular. That semicircular size is a size having a radius slightly larger than that of the semispherical boss 623. That is, the receiving portion 54 is sized to receive and engage the boss 623. The pair of receiving portions 54 are arranged at an interval of 180° in a circumferential direction of the flange portion 52. Specifically, the pair of receiving portions 54 are arranged on the flange portion 52 to match the arrangement positions of the pair of locking members 62.

The state shown in FIG. 9 is a state where the pinion gear 50 is lifted upwardly by the biasing force of the coil spring 80 and located at the first position. As shown in an enlarged partial sectional view in FIG. 9, the boss 623 of the locking member 62 is fitted in the receiving portion 54 of the flange portion 52. By this engagement of the boss 623 and the receiving portion 54, the rotation of the pinion gear 50 about the rotary shaft 53 is regulated.

Figure 11:
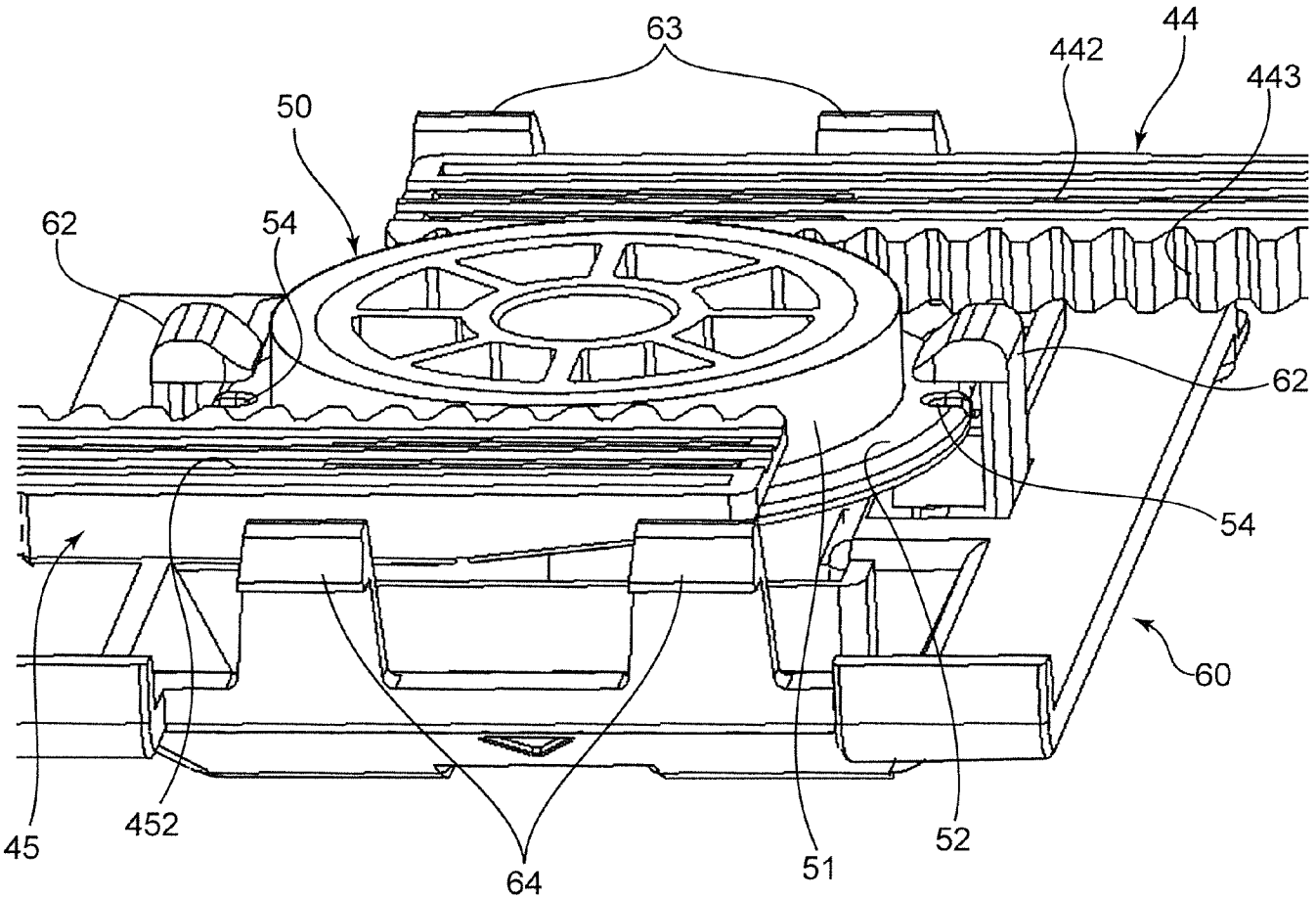
FIG. 11 is a perspective view showing a state where the pinion gear is pressed by the rack members.

On the other hand, FIG. 11 is a perspective view showing a state where the holding member 60 is attached to the base member 41 (not shown in FIG. 11). In this attached state, the pinion gear 50 is arranged between the rack base 442 of the first rack member 44 and the rack base 452 of the second rack member 45 and the rack gear teeth 443, 453 are meshed with the pinion gear teeth 51. At this time, the lower surfaces (pressing surfaces) of the rack bases 442, 452 are positioned to face the flange portion 52 and press the flange portion 52 downwardly. By this pressing, the pinion gear 50 is pressed downwardly.

That is, when the holding member 60 is attached to the base member 41, the pinion gear 50 moves to the second position against the biasing force of the coil spring 80 due to the interference of the rack bases 442, 452 (other members on the side of the sheet storage portion 151) and the flange portion 52. This disengages the bosses 623 and the receiving portions 54 and makes the pinion gear 50 rotatable about the axis of the rotary shaft 53. Specifically, when the holding member 60 is attached to the base member 41 by snap-fitting, the pinion gear 50 is pressed by the rack bases 442, 452 to be automatically positioned at the second position and allowed to make an original rotating movement. Note that friction is created between the pinion gear 50 and the rack bases 442, 452 due to the above pressing. This friction contributes to giving an appropriate operation feeling by suppressing floating when the first and second side guides 42, 43 are slid.

As described above, according to the side guide unit 40 of this embodiment, the assembly can be attached to the base member 41 (sheet storage portion 151) with the pinion gear 50, the sensor member 70 and the coil spring 80 assembled with the holding member 60. The pinion gear 50 is located at the first position with the holding member 60 detached from the base member 41 (FIG. 9). Thus, with the rotation of the pinion gear 50 regulated, the variable resistor 71 of the sensor member 70 and the rotary shaft 53 of the pinion gear 50 can be coupled.

The side guide unit 40 including the sensor member 70 needs to be so assembled that the positions of the first and second side guides 42, 43 in the width direction, i.e. the rotational position of the pinion gear 50 and an output electrical characteristic (resistance value) of the sensor member 70 are in a predetermined correspondence relationship. For example, the side guide unit 40 needs to be so assembled that the sensor member 70 outputs an output voltage set in advance in correspondence with the rotational position of the pinion gear 50, e.g. the sensor member 70 outputs a predetermined first voltage when the first and second side guides 42, 43 are maximally spaced apart and outputs a second voltage different from the first voltage when the first and second side guides 42, 43 are minimally spaced apart. If only this point is considered, the pinion gear 50 may be assembled in a non-rotatable state after the pinion gear 50 and the sensor member 70 are coupled. However, it is useless if the pinion gear 50 is not rotatable also after assembling. A means is also considered which provides the pinion gear 50 with a certain mark and lets an operator to perform an assembling operation in reliance on this mark. However, it presumably takes time and effort for the position alignment of the mark and this means cannot be said to be good in operability.

According to this embodiment, the sensor member 70 and the pinion gear 50 are first assembled by coupling the rotary shaft 53 of the pinion gear 50 to the bearing hole 72 of the sensor member 70 in the holding member 60. At this time, the pinion gear 50 is positioned at the first position by the biasing force of the coil spring 80. By the engagement of the bosses 523 and the receiving portions 54, the rotation of the pinion gear 50 about the axis is regulated and a rotational angle of the variable resistor 71 is positioned at a predetermined angle. That is, the resistance value of the variable resistor 71 is known at the first position. Thus, the rotational position of the variable resistor 71 of the sensor member 70 can be properly aligned with a predetermined reference position and maintained at this position.

Thereafter, the holding member 60 is attached to the base member 41 with the rotary shaft 53 and the bearing hole 72 coupled as described above. At this time, the pinion gear 50 is pressed down by the rack bases 442, 452, thereby moving to the second position. In this way, the bosses 623 and the receiving portions 54 are disengaged. That is, a rotation regulated state of the pinion gear 50 is released by attaching the holding member 60 to the base member 41 and a return is made to a state where an original function of the pinion gear 50 can be exhibited. The assembling of the side guide unit 40 with reference positions of the first and second side guides 42, 43 and a reference position of the sensor member 70 properly aligned is completed only by attaching the assembly to the base member 41 after the pinion gear 50 and the sensor member 70 are properly assembled on the holding member 60 in this way. Thus, assembling operability can be significantly improved.

Note that when the pinion gear 50 is pressed down by the rack bases 442, 452 and the pinion gear teeth 51 and the rack gear teeth 443, 453 are engaged, the first and second rack members 44, 45 are arranged at predetermined positions. For example, as shown in FIG. 4, the first and second rack members 44, 45 are arranged at most outward positions, i.e. positions corresponding to a largest sheet size. In this way, the resistance value of the variable resistor 71 can be set at a value (predetermined value) corresponding to the largest sheet size. According to this embodiment, the resistance value of the variable resistor 71 can be easily set by the engagement of the bosses 623 and the receiving portions 54.

Although the embodiment of the present disclosure has been described above, the present disclosure is not limited to this and, for example, can be modified as follows.

(1) In the above embodiment, the sheet feeder (side guide unit 40) according to the present disclosure is assembled with the sheet cassette 15 of the image forming apparatus 1. This application is an example. For example, application to an external sheet feeding unit, a manual sheet feeding unit and the like is also possible. Further, the present disclosure can be applied also to the pair of side guides 114 provided on the document tray 111 of the automatic document feeder 11. Alternatively, the present disclosure can be applied also to various sheet feeders other than those of image forming apparatuses.

(2) In the above embodiment, the potentiometer-type sensor is illustrated as the sensor member 70. Instead of this, a magnetic sensor, an optical sensor or the like may be used as the sensor member 70.

(3) In the above embodiment, the rotation of the pinion gear 50 is regulated by the engagement of the bosses 623 of the locking members 62 with the receiving portions 54 provided on the flange portion 52 of the pinion gear 50. This is an example. As long as parts of the pinion gear 50 are engaged with the locking members 62 based on the biasing force of the coil spring 80, an engagement mode does not matter. For example, the hook portions 622 of the locking members 62 may not include the bosses 623 and the flange portion 52 may be provided with shallow recesses into which the hook portions 622 themselves are fitted.

(4) In the above embodiment, the pinion gear 50 moves from the first position to the second position by being pressed by the rack bases 442, 452. Besides the rack bases 442, 452, an arbitrary member on the side of the sheet storage portion 151 may be used as a pressing surface or a pressing member may be newly added.

According to the present disclosure, the sensor member for sheet size detection can be accurately and easily assembled with the pinion gear. Thus, it is possible to precisely detect the sheet size and provide a sheet feeder with good assembling operability and an image forming apparatus using the same.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A sheet feeder, comprising:

a sheet storage portion configured to store a sheet to be fed;

a pair of side guides provided in the sheet storage portion, slidable in directions perpendicular to a sheet feeding direction and configured to guide a pair of lateral sides of the sheet extending along the sheet feeding direction;

a pair of rack members integrally mounted on the respective side guides;

a pinion gear including a rotary shaft and configured to rotate about an axis of the rotary shaft in a state meshed with the pair of rack members;

a sensor member including a rotating portion coupled to the rotary shaft and having an electrical characteristic changing according to a degree of rotation of the rotating portion rotating in conjunction with the rotary shaft; and a holding member including a locking member engageable with a part of the pinion gear and configured to hold the pinion gear and the sensor member;

wherein:

the holding member is detachably attachable to the sheet storage portion and configured such that the pinion gear and the rack members are meshed with the holding member attached to the sheet storage portion;

the holding member holds the pinion gear movably in an axial direction of the rotary shaft so that the pinion gear is displaceable between a first position where a part of the pinion gear is engaged with the locking member to regulate the rotation of the pinion gear and a second position where the engagement is released to make the pinion gear rotatable; and the pinion gear is located at the first position with the holding member detached from the sheet storage portion and located at the second position with the holding member attached to the sheet storage portion.

2. A sheet feeder according to claim 1, further comprising a biasing member configured to bias the pinion gear in the axial direction of the rotary shaft, wherein:

the pinion gear is positioned at the first position by a biasing force of the biasing member with the holding member detached from the sheet storage portion; and the pinion gear is positioned at the second position by moving against the biasing force due to interference with another member on the side of the sheet storage portion with the holding member attached to the sheet storage portion.

3. A sheet feeder according to claim 2, wherein:

the pinion gear includes a cylindrical portion formed with pinion gear teeth on an outer periphery of the cylindrical portion and a flange portion having a diameter larger than the hollow cylindrical portion;

each of the rack members includes a straight part formed with rack gear teeth and a pressing surface facing the flange portion; and the pressing surfaces press the flange portion while the pinion gear teeth are meshed with the rack gear teeth with the holding member attached to the sheet storage portion.

4. A sheet feeder according to claim 3, wherein the flange portion of the pinion gear includes an engaging portion to be engaged with the locking member.

5. A sheet feeder according to claim 1, wherein:

the sheet storage portion includes a base member serving as a movement base for the side guides and the rack members; and the holding member is attached to the base member with the rotating portion of the sensor member coupled to the rotary shaft of the pinion gear.

6. A sheet feeder according to claim 5, wherein:

the electrical characteristic of the sensor member is adjusted to a predetermined value at the first position and the pair of rack members are arranged at predetermined positions when the holding member is attached.

7. An image forming apparatus, comprising:

a sheet feeder according to claim 1; and an image forming unit configured to form an image on a sheet fed from the sheet feeder.

* * * * *